US005116302A

United States Patent [19]

Speroni et al.

[11] Patent Number: 5,116,302

[45] Date of Patent: May 26, 1992

[54] PROCESS AND APPARATUS FOR THE SEALING OF PAPER SHEETS

[75] Inventors: Armando Speroni; Aldo Bedodi, both of Milan, Italy

[73] Assignee: Datapac S.R.L., Rome, Italy

[21] Appl. No.: 420,039

[22] Filed: Oct. 11, 1989

[51] Int. Cl.[5] ..... B31B 21/26

[52] U.S. Cl. ..... 493/254; 156/209; 156/227; 156/308.8; 493/264; 493/328; 493/394

[58] Field of Search ..... 156/206, 209, 221, 308.8, 156/324, 227; 162/117, 132, 112, 113, 133, 201, 205; 264/113; 229/92.1; 493/186, 230, 233, 238, 244, 246, 264, 328, 254, 394

[56] References Cited

U.S. PATENT DOCUMENTS

| | | | |
|---|---|---|---|
| 1,944,794 | 1/1934 | Klinger | 493/254 |
| 2,198,460 | 4/1940 | Rickard | 493/328 |
| 2,834,809 | 5/1958 | Schutte et al. | 162/117 |
| 3,300,368 | 1/1967 | Cooper et al. | 162/113 |
| 4,074,959 | 2/1978 | Curry et al. | 162/132 X |
| 4,483,728 | 11/1984 | Bauernfeind | 156/324 X |
| 4,718,883 | 1/1988 | Schmidt | 493/394 |

FOREIGN PATENT DOCUMENTS

| | | | |
|---|---|---|---|
| 3915858 | 8/1990 | Fed. Rep. of Germany | 493/394 |

OTHER PUBLICATIONS

Casey, *Pulp and Paper*, 1952.

*Primary Examiner*—John J. Gallagher
*Assistant Examiner*—Steven D. Maki
*Attorney, Agent, or Firm*—Helfgott & Karas

[57] ABSTRACT

In the sealing of paper sheets, particularly envelopes, such as for example self-enveloping forms, by knurling of the edges to be joined together, the preliminary moistening of the same edges is provided, which leads to a seal tight closure or sealing.

6 Claims, 2 Drawing Sheets

Tav.I

PROCESS AND APPARATUS FOR THE SEALING OF PAPER SHEETS

BACKGROUND OF THE INVENTION

The present invention relates to a process and apparatus for sealing paper sheets along at least one edge thereof and particularly to the closing of envelopes, such as so-called self-enveloping forms without using to adhesive substances.

In the following description, self-enveloping forms will be disclosed as an example without this being construed as a limitation of the scope of the invention.

As it has been known in recent years the so-called self-enveloping forms have acquired widespread popularity such forms have been especially used for printing and mailing invoices, bills, etc., particularly from companies and suppliers of public utility services (electricity, gas, telephone, tap water), which are compelled to issue at very close times (actually every two months) bills or invoices for a great number of customers, such bills are to be mailed and delivered by the mail service (or equivalent service), and in order to take advantage of a discounted tariff with respect to the normal rate, the envelope must have an open side for postal inspection.

The self-enveloping form has permitted meet such a requirement since it can be supplied to the billing and printing centers as a continuous form strip and, once it has been printed and completed with the address of the customer, it is folded to form an envelope.

Such an envelope thus has one side thereof being naturally closed in correspondence to the final folding of the sheet which has already been folded in two or three parts at parallel folding lines, and the envelope must be then sealed along at least two of the three remaining edges depending on whether one open edge for postal inspection must be left.

According to a known and used technique such closing and sealing process has been carried out by coating a sheet which has not been yet folded but was provided with weakening lines for separating edges to be torn off and/or portions of the sheet, with an adhesive (either reversible or unreversible, depending on whether more than one operation of opening and closure of the "envelope" is required) before the processing thereof at the printing and billing center.

In the most widespread types of self-enveloping forms that the adhesive had to be applied along edge stripes of the still blank form or sheet on both sides of the sheet and the stripes were attached to mate with each other after several folding operations.

This fact has been a not negligible drawback and problem, as discussed in the preamble of the Italian patent No. 1,169,138 filed on 24th Nov. 1983 in the name of the inventors of the present invention.

This Italian patent discloses a solution of the technical problem of closing envelopes and particularly self-enveloping forms. The solution involves knurling the edges to be sealed, preferably by action of two opposed knurling rollers between which the superimposed and mating edges to be sealed are passed.

The pressure applied between the two rollers causes surface portions of the paper to be mutually deformed thus sealing together the two superimposed edges of the paper.

Obviously such a solution is useful only for the cases of sealing, sealing which can not be opened without being destroyed. The success of the sealing operation depends, however, on the careful control of the mechanical conditions under which it is carried out and on the paper having constant characteristics owing to the fact that, as already mentioned, the sealing is ensured by the simultaneous deformation of mating portions of the two sheets or edges of the paper sheet undergoing the action of the relieved and depressed portions of the two knurling rollers.

It is evident that any improvement in the surface deformation leads to an improved sealing, so that it is made suitable also for the cases to date excluded by the mailing service from the number of uses of this process, for instance the registered mail.

SUMMARY OF THE INVENTION

It is the main object of the present invention to ensure the sealing of envelopes, particularly self-enveloping forms fulfilling all the requirements both mechanical and of ruling nature, by means of a closing and sealing process including a knurling step, characterized in that the mating and superimposed paper edges to be subjected to the action of the knurling means are preliminarily moistened so that the paper forming the said edges has a moisture content of between 5% and 98% by weight referred to the paper weight.

It has been surprisingly found that when the knurling operation is carried out on the edges of thus moistened paper, a mutual interpenetration of the fibers forming the two paper edges takes place whereby the sealing is resistant to the opening efforts and in the long run, it disappears only with its destruction.

It is also an object of the present invention to provide a closing and sealing process of two paper surfaces, particularly of envelopes and preferably self-enveloping forms, of the type in which the edges to be sealed are subjected to the action of knurling means, characterized in that said edges, upon undergoing the action of the knurling means, have a moisture content higher than that of the paper to be printed, said moisture content being between 5% and 98%, preferably of the order of about 9-10%.

According to a preferred embodiment of the process of the present invention said edges are moistened immediately before arriving to the knurling means.

Another object of the present invention resides in the apparatus for carrying out the process as above defined, comprising conveying means adapted to transfer at least two sheets to be joined with the edges to be joined at the knurling means, characterized in that upstream of said knurling means moistening means for said edges to be joined are provided.

According to a preferred embodiment of the apparatus of the present invention, said knurling means includes two opposed rollers having knurling surfaces between which two edges to be closed or sealed are passed, under the simultaneous action of a knurling adjustable pressure, said moistening means consisting of spraying nozzles mounted in an upstream position in the path of the sheets to be joined, so as to apply against only the edges to be joined jets of atomized water, dosed in such a manner that in a predetermined time, a predetermined value of the moisture content of said edges is obtained.

In the case of self-enveloping forms the moistening nozzles are positioned downstream of the standard folding means for the forms coming out of the tearing or cutting means which in turn are positioned downstream of the printer. According to a modification several stations can be provided for the sealing process, and the knurling and corresponding moistening stations are positioned immediately downstream of each folding step of the form.

One of the main advantages of the present invention is that water can be also applied onto the paper surfaces opposite to those which are effectively in contact with each other and consequently those surfaces are simultaneously deformed and interpenetrated owing to the action of the knurling rollers.

The specific features and the advantages of the present invention shell more clearly appear from the following description of a preferred embodiment made with respect with the accompanying drawings.

DETAILED DESCRIPTION OF THE PREFERRED EMBODIMENTS

Before providing the detailed description with reference to the drawings, it must be stated in advance that as regards the knurling means and station and consequently the related apparatus, in the present specification reference is made to the specification and drawings of the above mentioned Italian Patent No. 1,169,138, herein inserted by reference as the whole.

Figure 1:
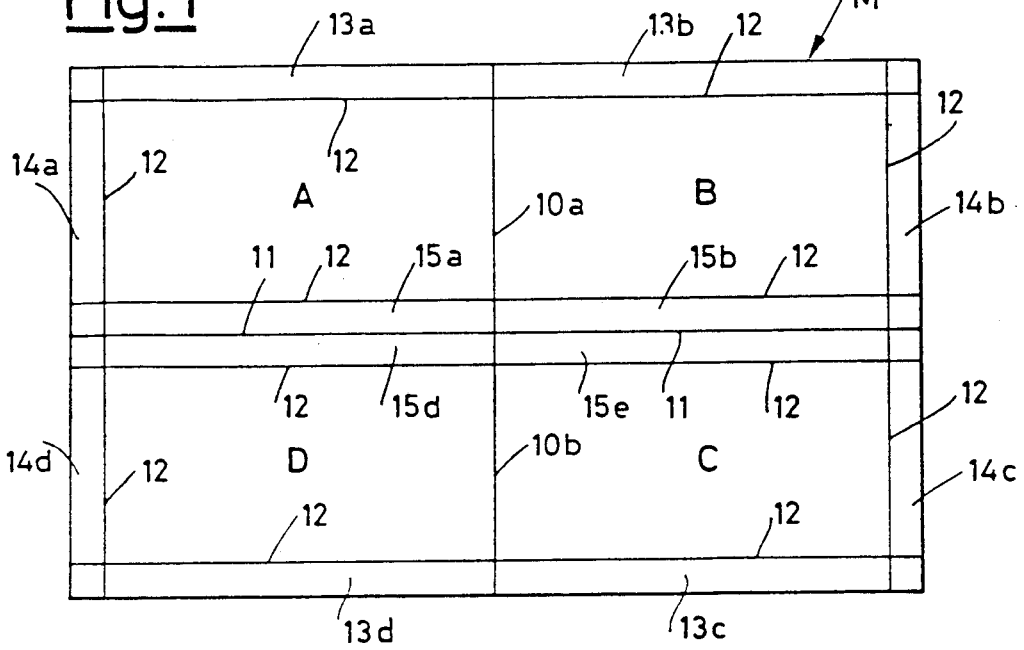
FIGS. 1, 2, 3 respectively show a self-enveloping form at several folding and sealing phases.
Figure 2:
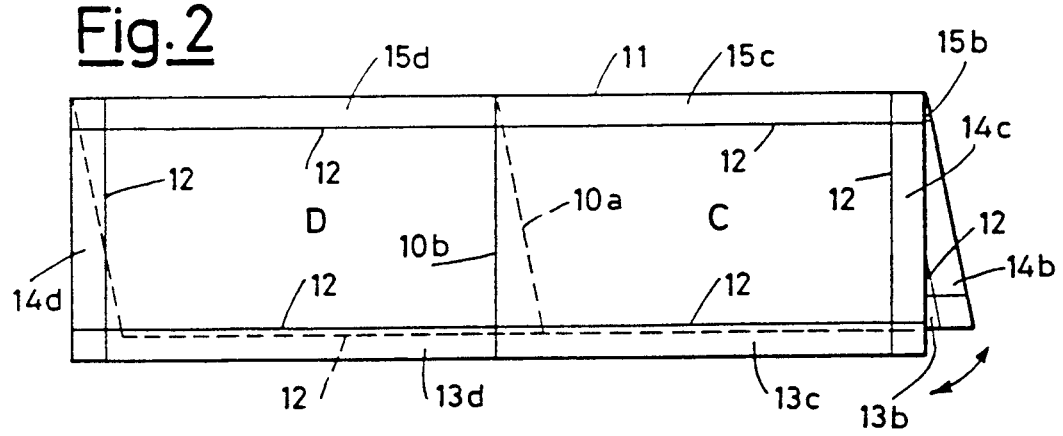
Figure 3:
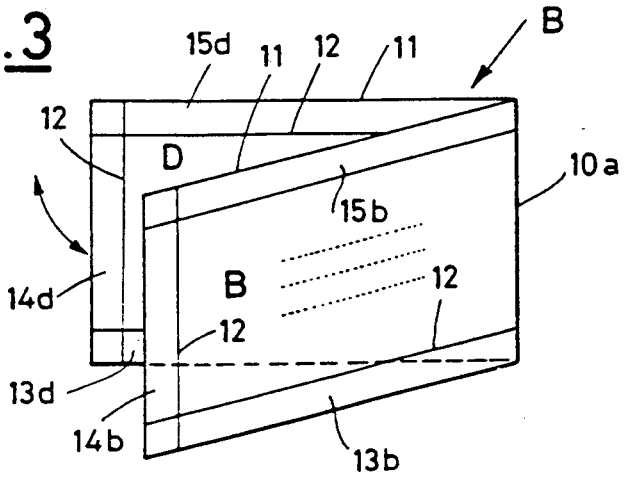

Referring now to FIGS. 1, 2 and 3, a form M is shown which is divided into four sectors A, B, C, D by two orthogonal folding lines 10 and 11.

The line 10 is formed by two portions 10A and 10B which define with line 11 adjacent sectors (A,B) and (C,D) which are folded as shown in FIGS. 2 and 3, since the folding with respect to line 10 takes place after the folding with respect to line 11. The folded envelope B' is shown in FIG. 3.

The lines 12 indicate weakening lines, formed for instance by means of holes, for the possible tearing of the corresponding edges of the envelope B.

The references 13 (a,b,c,d) , 14 (a,b,c,d) and 15 (a,b,c,d) indicate stripes or edges of paper defined by the weaking lines 12.

As it can be seen from the FIGS. 1, 2 and 3, the form M coming out of the printer and thus completed, for example in form of a bill or invoice and possibly divided into in two half forms, namely the zones A and B for the true bill, and zones C and D for a form for postal and/or bank payment, is firstly folded along the middle line 11 taking the configuration of FIG. 2 and thereafter is folded again along the folding lines 10*a* and 10*b* taking the configuration of FIG. 3.

When the sheet is in the configuration of FIG. 2, the edges 14*a*, 14*d*, and 14*b* and 14*c* are sealed together by means of the apparatus of the above identified Italian Patent. According to the present invention these edges, before undergoing the action of the knurling rollers 4, 4' of the above identified Patent (and also shown in FIG. 4), are moistened so that their moisture content is brought to about 9%, in the manner hereinafter described with reference to FIG. 4.

Likewise when the folding of FIG. 3 has been carried out, the edges 13*a*, 13*b*, 13*c* and 13*d* as well as 15*a*, 15*b*, 15*c* and 15*d* are sealed together. In this case too, before the action of the knurling rollers 4, 4' is applied to the surfaces to be sealed an adequate moistening takes place as hereinafter described.

Figure 4:
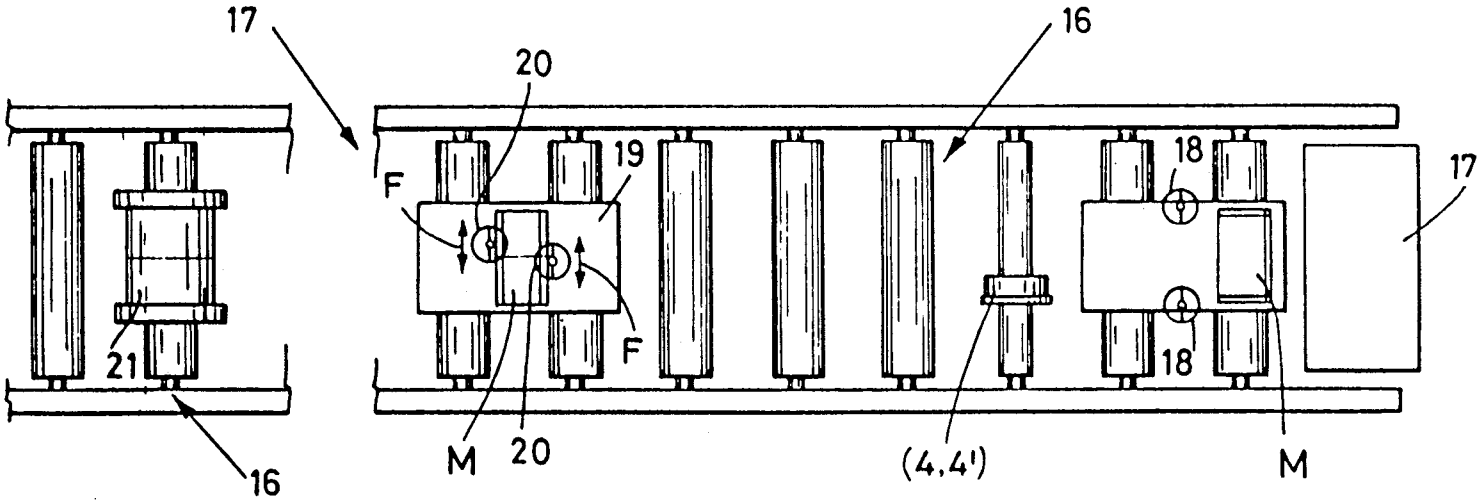
FIG. 4 is a schematic plant view from above of the apparatus according to the invention.

Referring now to FIG. 4, reference 16 indicates a conveying belt (in form of belt or rollers) onto which the forms M are transported to a folding device 17 in the condition of FIG. 2.

Reference numerals 18 indicate two spraying heads of a commercially available type. The spraying heads 18 are adapted to guide a jet of atomized water onto the paper at a suitable distance.

In FIG. 4 the folded form in the condition of FIG. 2, coming out of the moistening station with spraying heads 128 has the edges 14*a*, 14*b*, 14*c* and 14*d* moistened and ready to undergo the action of the knurling rollers (4, 4') which are effective in this position.

Once this phase of partial sealing in completed, the form M must undergo a second folding, passing from the condition of FIG. 2 to that of FIG. 3.

Before this phase the form enters the second moistening station 19 in which the spraying nozzles 20 carry out the moistening function for the edges 13*d* and 15*c*.

To this end the nozzles 20 are mounted in a crosswise movable manner (as shown by arrows F) with respect to the advancing direction of the conveying belt 16 and, at the station 19 the form M must stop for the time necessary for the operation of the moistening nozzles.

The moistening is immediately followed by a not shown folding station.

Obviously downstream of the moistening station 19, a further station 21 for the sealing, by means of the action of knurling rollers, is provided.

The above description has been made with a reference to the simplest self-enveloping form type. It is evident that the same sealing can be applied to self-enveloping forms of different type, such as for example those with double folding (namely with two crossing folding lines 11).

As already mentioned, the present invention may find suitable application to the closing and the sealing of conventional envelopes as well as to the closing and sealing of other paper or paper board products, such as for example paper board boxes, since by applying the principle of the preliminary moistening it is only necessary to provide an effective knurling action, namely an interference pressure between the two knurling rollers adapted to the thickness and the properties of the two paper edges to be sealed together.

It is thus meant that the invention is not to be construed as limited to the shown and/or described embodiment but may be applied to other cases of the sealing of two surfaces of paper or paper board by means of knurling with preliminary moistening.

We claim:

1. An apparatus for closing and sealing edges of paper envelopes, comprising a plurality of folding means including first means for folding a paper sheet along one of orthogonal axes thereof; a plurality of moistening means including first means for moistening opposing edges of said folded sheet to be sealed, a plurality of pairs of knurling rollers including a first pair of knurling rollers applying pressure to said edges for closing and sealing said moistened edges; said plurality of folding means including second means for folding said paper sheet along another of orthogonal axes thereof; said plurality of moistening means including second means for moistening opposing edges of said double-folded paper sheet to be sealed; said plurality of pairs of knurling rollers including a second pair of knurling rollers applying pressure to said opposing edges of said double-folded paper sheet for closing and sealing said opposing edges; and an elongated paper sheet-conveying belt for advancing said paper sheet through said plurality of folding means, said plurality of moistening means, and said plurality of pairs of knurling rollers, wherein moisture content of said paper sheet moistened by each jet is between 5% and 98% by weight, whereby all edges of the paper sheet to be sealed are closed and sealed without application of any adhesive therebetween, each of said moistening means being positioned between a respective folding means and a respective pair of knurling rollers so as to apply moisture to the edges to be sealed immediately before each sealing procedure.

2. The apparatus according to claim 1, wherein said first moistening means include two spraying heads for moistening said opposing edges with a jet of atomized water and positioned at said conveying belt opposite each other for applying water onto the edges parallel to an axis of elongation of said conveying belt, and said second moistening means include two spraying heads for moistening said edges with a jet of atomized water and positioned at said conveying belt for applying water onto the edges transversely of the axis of elongation of said conveyor belt.

3. The apparatus according to claim 2, wherein the spraying heads of said second moistening means are reciprocally movable in the direction transversal to the elongation of the conveying belt.

4. A process for closing and sealing edges of paper envelopes, comprising the steps of:

folding a paper sheet along one of orthogonal axes thereof at a first folding station;

moistening edges of said folded sheet to be sealed;

applying pressure of first knurling rollers to said moistened edges to close and seal said edges;

advancing said paper sheet to a second folding station and folding said paper sheet along another of orthogonal axes thereof at said second folding station;

moistening opposing edges of said double-folded paper sheet to be sealed; and applying pressure of second knurling rollers to said opposing edges for closing and sealing said edges, wherein moisture content of said paper sheet in each moistening step is between 5% and 98% by weight, and wherein each moistening step is carried out immediately before each of said pressure-applying steps, whereby said edges are closed and sealed due to deformation and mutual interpenetration of fibers of the edges being moistened and sealed by said knurling rollers without application of any adhesive therebetween.

5. The process according to claim 4, wherein said edges are moistened with a jet of atomized water applied to said edges by spraying in each moistening step.

6. A process according to claim 4, wherein said moisture content is about 9-10%.

* * * * *